US007048114B1

(12) United States Patent
Prottas

(10) Patent No.: US 7,048,114 B1
(45) Date of Patent: May 23, 2006

(54) CONTACT LENS STORAGE CASE

(76) Inventor: Jenny Prottas, 36 Widgeon Way, Greenwich, CT (US) 06830

( * ) Notice: Subject to any disclaimer, the term of this patent is extended or adjusted under 35 U.S.C. 154(b) by 0 days.

(21) Appl. No.: 10/758,765

(22) Filed: Jan. 16, 2004

Related U.S. Application Data

(60) Provisional application No. 60/440,477, filed on Jan. 16, 2003.

(51) Int. Cl.
*A45D 33/26* (2006.01)
*B65D 71/00* (2006.01)

(52) U.S. Cl. ..... 206/229; 206/5.1; 206/581; 132/287; 132/315

(58) Field of Classification Search ..... 206/5.1, 206/229, 570, 581, 203; 132/287, 314, 315
See application file for complete search history.

(56) References Cited

U.S. PATENT DOCUMENTS 1,512,981 A * 10/1924 Gordon ..... 206/235
1,650,672 A * 11/1927 Walinsky ..... 190/111
1,767,567 A * 6/1930 Weil ..... 132/294
3,089,500 A 5/1963 Stalcup
3,337,047 A 8/1967 Otis et al.
3,394,717 A 7/1968 Hollinger
3,537,552 A * 11/1970 Noble ..... 190/111
3,966,076 A 6/1976 Kroger et al.
4,085,845 A * 4/1978 Perfect ..... 206/564
4,782,942 A 11/1988 Ashley et al.
4,823,944 A 4/1989 Ryder
5,375,699 A 12/1994 Amend
5,848,700 A * 12/1998 Horn ..... 206/570
5,878,757 A * 3/1999 Hernandez ..... 132/287

* cited by examiner

*Primary Examiner*—David T. Fidei
(74) *Attorney, Agent, or Firm*—Schweitzer Cornman Gross & Bondell LLP

(57) ABSTRACT

A contact lens carrying case comprises first and second storage portions, pivotally attached to each other, along with a latch mechanism for maintaining the first and second portions in a closed orientation. The first portion has a work surface exposed to a user when the case is in the open orientation on which the user can place lens maintenance paraphernalia, and has at least one lens cleaning depression located in the work surface in which a lens can be washed or rinsed. A drawer may be located below the work surface for storage. The second portion contains first and second contact lens storage areas for respectively storing an inventory of right and left contact lenses. A central storage area is located between the contact lens storage areas for storage of ancillary materials, including lens cleaning/rinsing solution, a portable lens case, and or eyeglasses.

8 Claims, 2 Drawing Sheets

CONTACT LENS STORAGE CASE

The present invention relates to a new and improved storage case for contact lenses and accessories therefor. This application claims the benefit of Provisional Application 60/440,477 of Jan. 16, 2003.

BACKGROUND OF THE INVENTION

The use of contact lenses to correct vision deficiencies is well known and well accepted. A wide variety of contact lenses are on the market. Modern contact lenses are formed of a plastic composition that, while providing much comfort for the wearer, also requires some degree of care. The lenses may be required to be removed for cleaning. Some contact lenses require that they be removed while the wearer sleeps. In addition, the entry of foreign material into the eye, such as dust or grit, may require that the lens be removed and washed.

In addition to maintenance procedures, some modern contact lenses are intended to be replaced on a relatively short, periodic schedule. Thus, the wearer must maintain an inventory of lenses to insure that a replacement lens is always available for wearing.

It accordingly would be of great benefit to a contact lens user to have an attractive and compact storage case that would allow all the requirements for contact lens care, including an inventory of lenses, to be maintained for availability whether the wearer is at home or away.

There have been attempts to provide various cases and dispensers for contact lenses and ancillary equipment, such as U.S. Pat. No. 4,574,944 of Mar. 11, 1986 to Gregory; U.S. Pat. No. 3,394,717 of Jul. 30, 1968 to Hollinger; U.S. Pat. No. 3,089,500 of May 14, 1963 to Stalcup; and U.S. Pat. No. 3,337,047 of Aug. 22, 1967 to Otis, et al. Each of these devices, however, suffer from one or more deficiencies.

It is accordingly a purpose of the present invention to provide a case or container for the storage of contact lenses and accessories therefor, which is convenient, compact and transportable.

Yet a further purpose of the present invention is to provide such a case that will allow an inventory of individual lenses to be stored in a manner whereby lenses for each eye can be differentiated.

Still a further purpose of the present invention is to provide a case as aforesaid, which provides a facility for lens cleaning.

BRIEF DESCRIPTION OF THE INVENTION

In accordance with the foregoing and other purposes and objects, a contact lens storage case constructed in accordance with the present invention includes first and second pivotally joined portions, each of which provides for storage of contact lenses and/or ancillary devices. The first portion also has a work surface with integral depressions that are exposed when the case is open to provide individual liquid-holding areas in which lenses can be washed or rinsed. A storage area is located below the work surface.

The second portion of the case provides a pair of storage areas for an inventory of individually-packaged lenses, as well as an area in which lens care materials and auxiliary products may be retained. The second portion of the case may be pivotally oriented in a variety of positions with respect to the first portion and can be maintained in a vertical position, whereby access to the stored materials can be made while the first portion of the case rests on a horizontal surface to facilitate use of the work surface and depressions. The second portion may include a mirror on a surface thereof, the second portion being tiltable into positions other than the vertical to allow use of the mirror by the wearer. When closed, the case may be easily transported, providing access to all contact lens-related materials that the wearer may require.

BRIEF DESCRIPTION OF THE DRAWINGS

A fuller understanding of the present invention can be accomplished by consideration of the following, detailed description of a preferred, but nonetheless illustrative embodiment thereof, when reviewed in connection with the annexed drawings, wherein.

DETAILED DESCRIPTION OF THE INVENTION

Figure 1:
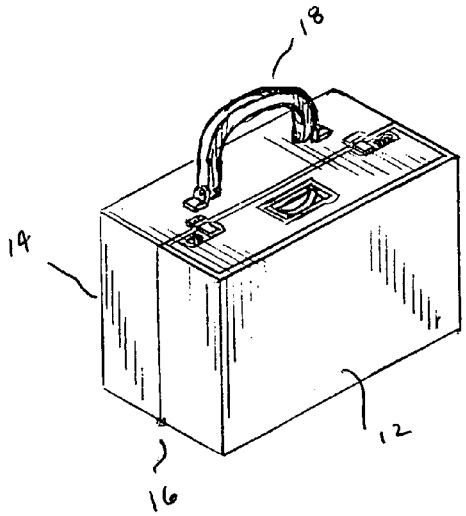
FIG. 1 is a perspective view of the case in the closed configuration.

As depicted in the Figures, contact lens case 10 comprises first and second portions or sections 12, 14 hingedly joined at 16. The case may be provided with a carrying handle 18 and releasable latches 20 to maintain the portions 12 and 14 in a closed position for transport purposes. The case may be constructed of any appropriate rigid and lightweight material, such as a plastic composition or anodized aluminum, and may be formed by any one of a variety of methods as known in the art.

The first portion 12 is provided with a top surface 22 forming a counter or work surface. Formed into the work surface 22 are a pair of spaced dish-like depressions 24. Each of the depressions may be on the order of two inches in diameter with a depth in the range of approximately one-half inch. Each of the depressions is appropriately dimensioned and configured to serve as a cleaning station for a contact lens 26 placed therein. Each of the depressions is capable of being filled with an appropriate liquid, such as distilled water or a cleaning solution, to wash and/or otherwise treat the contact lenses 26 as may be required. The surrounding area of the work surface 22 may accommodate the lenses before or after cleaning, and/or other materials that the user may wish to employ or have access to when the case is open. To facilitate disposal of the liquid after cleaning, a thin liner 28 may be provided, contoured to rest within the depression. The liner may be removed from the depression and discarded or cleaned as appropriate for re-use. In such a case the depressions may be formed with one or more peripheral arcuate recess portions 30 to accommodate the user's fingers to facilitate removal of the liner.

The work surface 22 forms the top wall for a cavity in the first portion of the case which contains drawer 32. The drawer has a front face 34 forming an exterior wall of the first portion 12. The drawer front face 34 carries a preferably recessed handle 36, which allows the drawer to be withdrawn from the case. Handle 36 may also include a locking mechanism to retain the drawer in the first portion 12 when the handle is in a first position. This may be of particular importance when portions of the case latch mechanism 20 are located on the drawer front face. The drawer 32 provides a further receptacle for miscellaneous equipment and devices, such as a sterile wipe, additional contact lenses, replacement depression liners 28, and the like. To facilitate full opening of the drawer, the dish-like depressions 24 in the work surface 22 may be constructed as detailed in FIG. 3 such that their bottom surfaces do not extend below, or otherwise impinge upon the bottom surface 38 of the work surface 22, thus allowing the drawer 32 to be fully removed. In place of a handle, the drawer may be provided with a push-actuated ejecting latch mechanism as known in the art.

Figure 2:
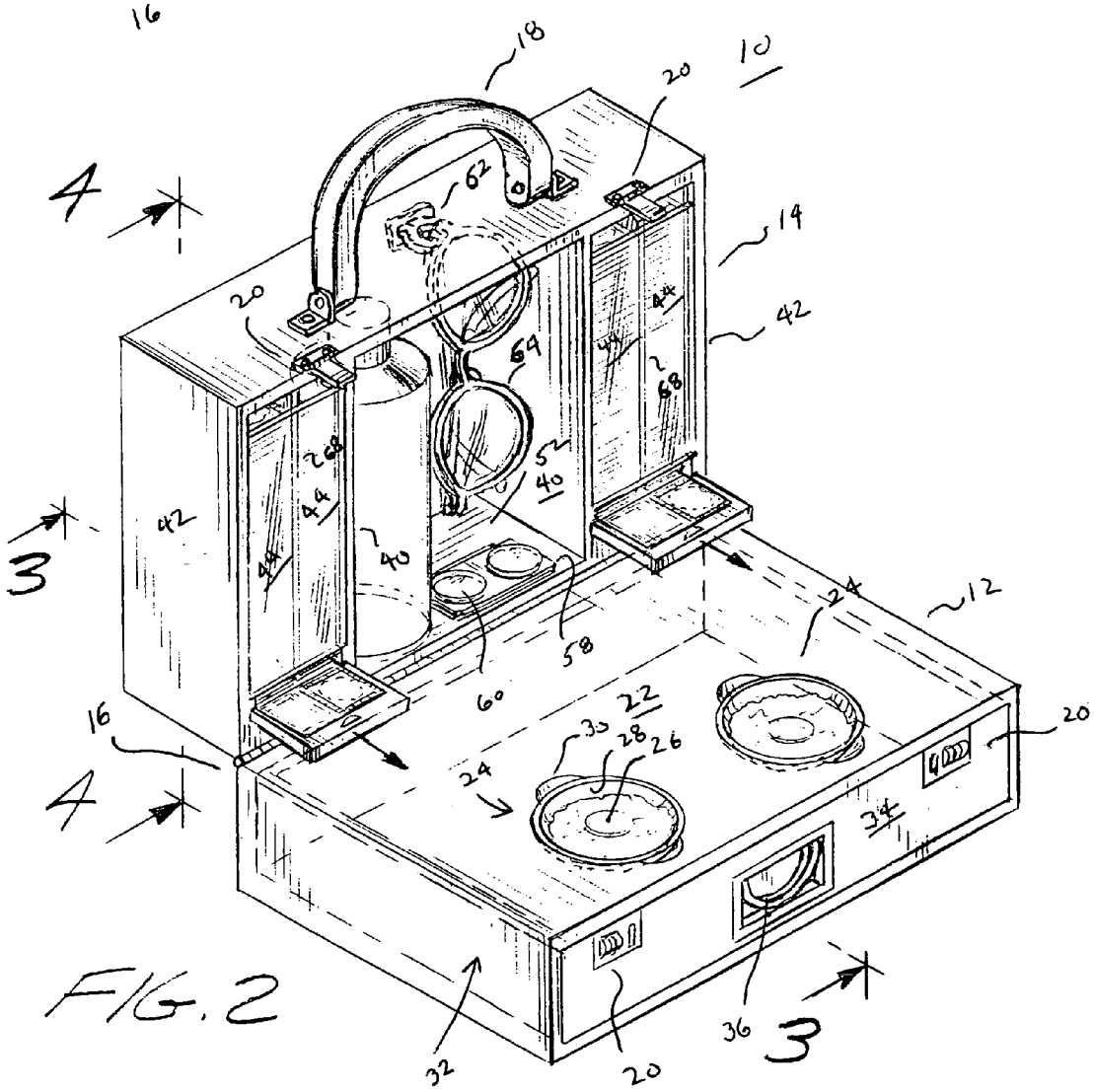
FIG. 2 is a perspective view of the case in an open configuration, whereby access to the stored items can be accomplished and use of the work surface implemented.

Second portion 14 of the lens case further provides storage means to accommodate a variety of lens-associated elements. As seen in FIG. 2, the exterior walls or sides of second portion 14 form an enclosed space within the second portion in which a pair of spaced interior walls 36 are positioned. Each of the interior walls 40, in cooperation with the adjacent side wall 42, define a storage area or compartment for an inventory of lenses. As depicted, the storage areas may each be adapted to hold a pair of adjacent stacks 44 of individually-packaged lenses. The adjacent stacks may be further separated from each other and aligned by a secondary divider wall 68. A tray-like dispensing element 46 is located at the lower end of the storage area, and at least partially supports the lens stacks. The dispensing element rides in a pair of opposed wall slots and includes an catch mechanism to engage the lowermost-staked lens packages and withdraw them from the stack for use when the dispenser is pulled forward. The remaining stacked lens are maintained and retained in the stacked arrangement by a front cover 48, which may be of Plexiglas or other transparent material, with a loading slot 50 at its upper end to allow the lens packages to be stacked. Alternatively, other cover and dispensing means may be provided, such as a lockable access door extending the length of the stack. It is contemplated that the lenses be stored such that the inventory of lenses for the right eye be place in the right compartment, while lenses for the left eye be placed in the left compartment. This prevents inadvertent mix-up, and facilitates removal and correlation between the lens and the eye of the wearer.

Figure 3:
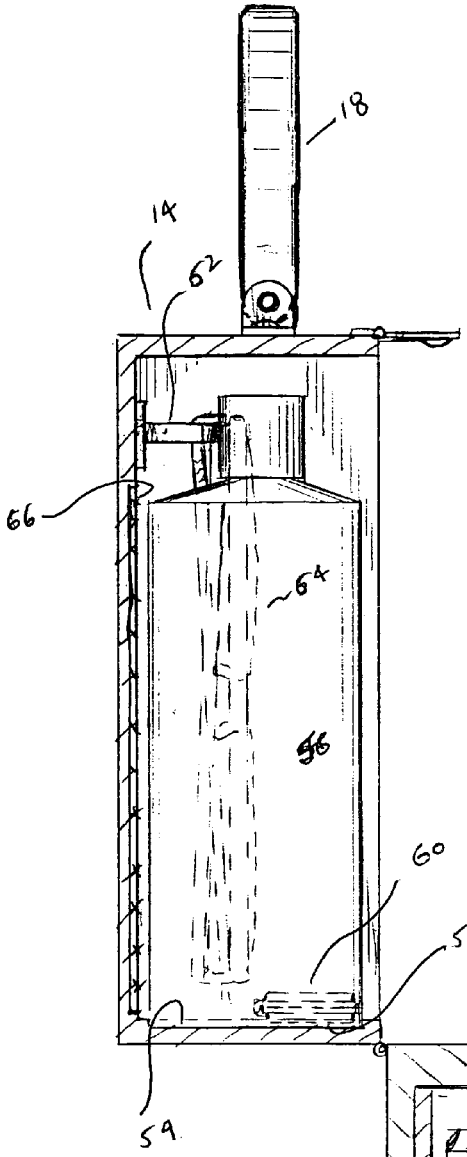
FIG. 3 is an elevation view, in section, taken along line 3—3 of FIG. 2.
Figure 4:
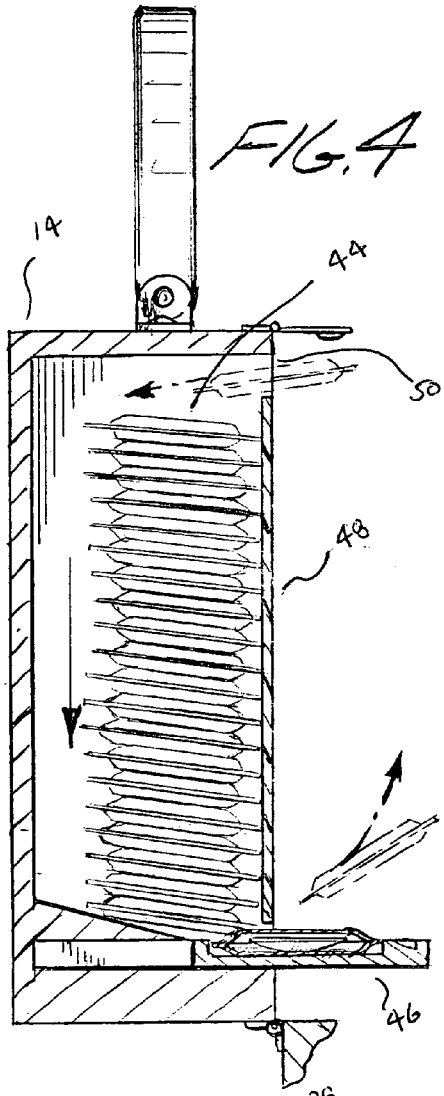
FIG. 4 is an elevation view, taken along line 4—4 of FIG. 2.
Figure 4:
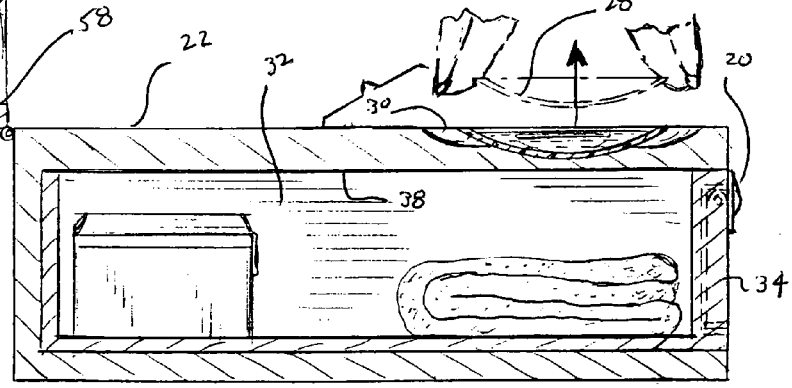

The interior space between the lens inventory regions may also be used to store ancillary equipment. As illustrated, the floor 52 of the central area may be provided with a recess 54, as depicted in FIG. 3, to accept the bottom of a container 56 for, for example, distilled water or lens cleaning solution. An appropriate strap (not shown) can be provided to retain the container in an upright position when the case is open or closed. Floor 52 may also be provided with a recess 58 to accept a portable, daily lens carrying case 60, while the rear wall of the space may include an elastic loop 62 located proximate the upper edge thereof by which a pair of eyeglasses 64 may be hung. The back surface of the central portion may further be provided with a mirror surface 66, overlying all or a portion thereof. With the inserted objects, such as glasses 64 and/or container 56 removed, the mirror can be used by the wearer in connection with lens insertion and removal and for ancillary purposes. In a preferred embodiment of the invention, the hinge 16 may be adapted to allow the second portion 14 to be maintained in a variety of orientations with respect to the first portion when the case is opened. Accordingly, in a first perpendicular position, as illustrated in the drawings, the inventory of the lenses may be easily accessed, while in an alternative orientation the second portion 14 may be angled such that the mirror surface 66 is appropriately oriented for use by the user without the necessity of manual support of the portion.

The invention as described herein provides a convenient, compact facility for the care and storage of contact lens and ancillary devices. One skilled in the art will appreciate that modifications to the embodiment as specifically set forth herein may be accomplished without departing from the scope of the invention as set forth in the annexed claims.

I claim:

1. A contact lens carrying case, comprising:

first and second storage portions, pivotally attached to each other;

a latch mechanism associated with the portions for maintaining the first and second portions in a closed orientation;

the first portion, having a work surface located forward of the second storage portion and exposed to a user when the case is in the open orientation, said work surface being free of any structures vertically extending from its surface or lying above its surface to provide the user with an unobstructed work area;

at least one lens cleaning depression located in the work surface;

first and second contact lens storage areas located in the second portion for respectively storing right and left contact lenses; and a central storage area located between the contact lens storage areas for storage of ancillary materials, said storage area being sized to allow the storage of a liquid container and a portable contact lens carrying case.

2. The contact lens carrying case of claim 1, further comprising a drawer located in the first storage portion, the drawer being located in an opening having a top wall defined by said work surface.

3. The contact lens carrying case of claim 1, further comprising a removable liner for said lens cleaning depression.

4. The contact lens carrying case of claim 1, wherein said first and second contact lens storage areas are each defined by a side wall of the second storage portion and an interior wall spaced from the side wall a distance sufficient to allow a plurality of individually packaged contact lenses to be stacked therebetween, and a dispenser located at a lower end of the contact lens storage area for removing a lowermost one of said stacked contact lenses for dispensation.

5. The contact lens carrying case of claim 4, wherein said first and second contact lens storage areas further include a transparent front wall for maintaining the stacked contact lenses within the storage area.

6. The contact lens carrying case of claim 5, wherein said front wall includes a loading slot for the contact lenses.

7. The contract lens carrying case of claim 1, wherein said central storage area includes an eyeglass storage loop, said eyeglass storage loop providing a support on which a pair of eyeglasses may be hung.

8. The contact lens carrying case of claim 1, wherein the central storage area includes means for supporting at least one a liquid container and a portable contact lens carrying case.

* * * * *